US012285659B2

(12) United States Patent
Yano et al.

(10) Patent No.: US 12,285,659 B2
(45) Date of Patent: Apr. 29, 2025

(54) GOLF CLUB HEAD

(71) Applicant: BRIDGESTONE SPORTS CO., LTD., Tokyo (JP)

(72) Inventors: Takeyuki Yano, Tokyo (JP); Wataru Ban, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 43 days.

(21) Appl. No.: 18/318,544

(22) Filed: May 16, 2023

(65) Prior Publication Data

US 2023/0415004 A1 Dec. 28, 2023

(30) Foreign Application Priority Data

Jun. 23, 2022 (JP) ..... 2022-101083

(51) Int. Cl.
*A63B 53/06* (2015.01)
*A63B 53/04* (2015.01)

(52) U.S. Cl.
CPC ..... *A63B 53/0433* (2020.08); *A63B 53/0412* (2020.08); *A63B 53/0466* (2013.01); *A63B 2209/02* (2013.01)

(58) Field of Classification Search
CPC ..... A63B 53/0412; A63B 2053/0491; A63B 2053/0495
USPC ..... 473/335, 336
See application file for complete search history.

(56) References Cited

U.S. PATENT DOCUMENTS 5,421,577 A * 6/1995 Kobayashi ..... A63B 53/04 473/335
5,851,160 A * 12/1998 Rugge ..... A63B 60/00 473/349
6,162,132 A * 12/2000 Yoneyama ..... A63B 53/0466 473/345
6,254,494 B1 * 7/2001 Hasebe ..... A63B 53/04 473/345
6,306,048 B1 * 10/2001 McCabe ..... A63B 53/04 473/335
6,494,790 B1 * 12/2002 Toyota ..... A63B 53/0466 473/345
6,533,679 B1 * 3/2003 McCabe ..... A63B 60/02 473/335
8,951,143 B2 * 2/2015 Morales ..... A63B 60/00 473/409

(Continued)

FOREIGN PATENT DOCUMENTS

JP 2006167163 A * 6/2006
JP 2006320493 A * 11/2006

(Continued)

*Primary Examiner* — Alvin A Hunter
(74) *Attorney, Agent, or Firm* — IPUSA, PLLC

(57) ABSTRACT

A golf club head having a volume of from 400 cc through 460 cc includes: a face portion that includes a face surface that is to be a striking surface; and a body portion that includes carbon fiber-reinforced plastics. The body portion includes a sole portion, a crown portion, and a weight member attached to the sole portion at an inner-surface side thereof. The weight member includes a first weight member that is disposed directly below a center of gravity of the golf club head, and a second weight member that extends from the first weight member in a toe-heel direction.

13 Claims, 10 Drawing Sheets

(56) References Cited

U.S. PATENT DOCUMENTS 8,968,116 B1 * 3/2015 Myers ..... A63B 60/00 473/335
9,089,748 B2 * 7/2015 Morales ..... A63B 60/02
9,623,302 B1 * 4/2017 Myers ..... A63B 53/0466
9,770,635 B2 * 9/2017 Motokawa ..... A63B 60/04
10,213,665 B1 * 2/2019 Day ..... A63B 53/0466
10,709,940 B2 * 7/2020 Kitagawa ..... A63B 53/08
10,981,037 B2 * 4/2021 Parsons ..... A63B 60/02
2002/0004428 A1 * 1/2002 Takeda ..... A63B 53/02 473/345
2002/0160854 A1 * 10/2002 Beach ..... A63B 53/0466 473/345
2003/0034142 A1 * 2/2003 Bliss ..... A63B 53/0466 164/76.1
2003/0148818 A1 * 8/2003 Myrhum ..... A63B 69/3658 473/290
2003/0171161 A1 * 9/2003 Nishio ..... A63B 53/0466 473/345
2005/0148405 A1 * 7/2005 Imamoto ..... A63B 53/0466 473/345
2005/0181887 A1 * 8/2005 Sano ..... A63B 53/0466 473/316
2006/0073910 A1 * 4/2006 Imamoto ..... A63B 60/02 473/345
2006/0240908 A1 * 10/2006 Adams ..... A63B 60/02 473/335
2007/0049400 A1 * 3/2007 Imamoto ..... A63B 60/02 473/345
2007/0238551 A1 * 10/2007 Yokota ..... A63B 60/52 473/349
2008/0261715 A1 * 10/2008 Carter ..... A63B 53/047 473/335
2010/0075774 A1 * 3/2010 Ban ..... A63B 60/02 473/336
2010/0144461 A1 * 6/2010 Ban ..... A63B 53/0466 473/338
2010/0151964 A1 * 6/2010 Soracco ..... A63B 60/54 473/332
2010/0167837 A1 * 7/2010 Ban ..... A63B 53/04 473/336
2013/0130832 A1 * 5/2013 Morales ..... A63B 53/0466 473/345
2014/0031141 A1 * 1/2014 Myrhum ..... A63B 60/02 473/334
2014/0080629 A1 * 3/2014 Sargent ..... A63B 53/02 473/336
2014/0080631 A1 * 3/2014 Deshmukh ..... A63B 53/04 473/345
2015/0306475 A1 * 10/2015 Curtis ..... A63B 53/06 473/345
2017/0072277 A1 * 3/2017 Mata ..... A63B 60/52
2019/0134471 A1 * 5/2019 Kitagawa ..... A63B 53/0466
2020/0094116 A1 * 3/2020 Kato ..... A63B 53/0466
2021/0086039 A1 * 3/2021 Aramaki ..... A63B 60/52
2021/0138316 A1 * 5/2021 Mizutani ..... A63B 53/0433
2023/0415004 A1 * 12/2023 Yano ..... A63B 53/0466

FOREIGN PATENT DOCUMENTS

JP 2010069106 A * 4/2010 ..... A63B 53/0466
JP 2013183972 A * 9/2013
JP 2018126189 A * 8/2018
JP 2020039824 A * 3/2020
JP 2020124360 A * 8/2020
JP 2021-010440 2/2021
JP 2021053431 A * 4/2021 ..... A63B 53/04
JP 2021-074201 5/2021
JP 7034671 3/2022

* cited by examiner

GOLF CLUB HEAD

CROSS-REFERENCE TO RELATED APPLICATIONS

This application is based upon and claims priority to Japanese Patent Application No. 2022-101083 filed on Jun. 23, 2022, the entire contents of which are incorporated herein by reference.

BACKGROUND OF THE INVENTION

1. Field of the Invention

The present disclosure relates to a golf club head.

2. Description of the Related Art

In recent years, the volume of a golf club head has been becoming larger. The golf club head having such a large volume offers a visual sense of relief to users. In such a golf club head, however, a weight member may be disposed at a position away from the center of gravity of the golf club head. In this case, users may feel that it is uncomfortable to swing a golf club with the golf club head.

RELATED-ART DOCUMENTS

Patent Documents

Patent Document 1: Japanese Patent Application Publication No. 2021-10440

Patent Document 2: Japanese Patent No. 7034671

Patent Document 3: Japanese Patent Application Publication No. 2021-74201

SUMMARY OF THE INVENTION

A golf club head according to an aspect of the present disclosure has a volume of from 400 cc through 460 cc. The golf club head includes a face portion including a face surface that is to be a striking surface, and a body portion including carbon fiber-reinforced plastics. The body portion includes a sole portion, a crown portion, and a weight member attached to the sole portion at an inner-surface side thereof. The weight member includes a first weight member disposed directly below the center of gravity of the golf club head, and a second weight member extending from the first weight member in a toe-heel direction.

DETAILED DESCRIPTION OF EMBODIMENTS

The present disclosure aims to provide a golf club head for a golf club that is comfortable for a user to swing.

According to the disclosed technique, it is possible to provide a golf club head for a golf club that is comfortable for a user to swing.

Hereinafter, embodiments of the present disclosure will be described with reference to the drawings. Note that, the same components are denoted by the same reference symbols throughout the drawings, and duplicate descriptions thereof may be omitted.

First Embodiment

Figure 1:
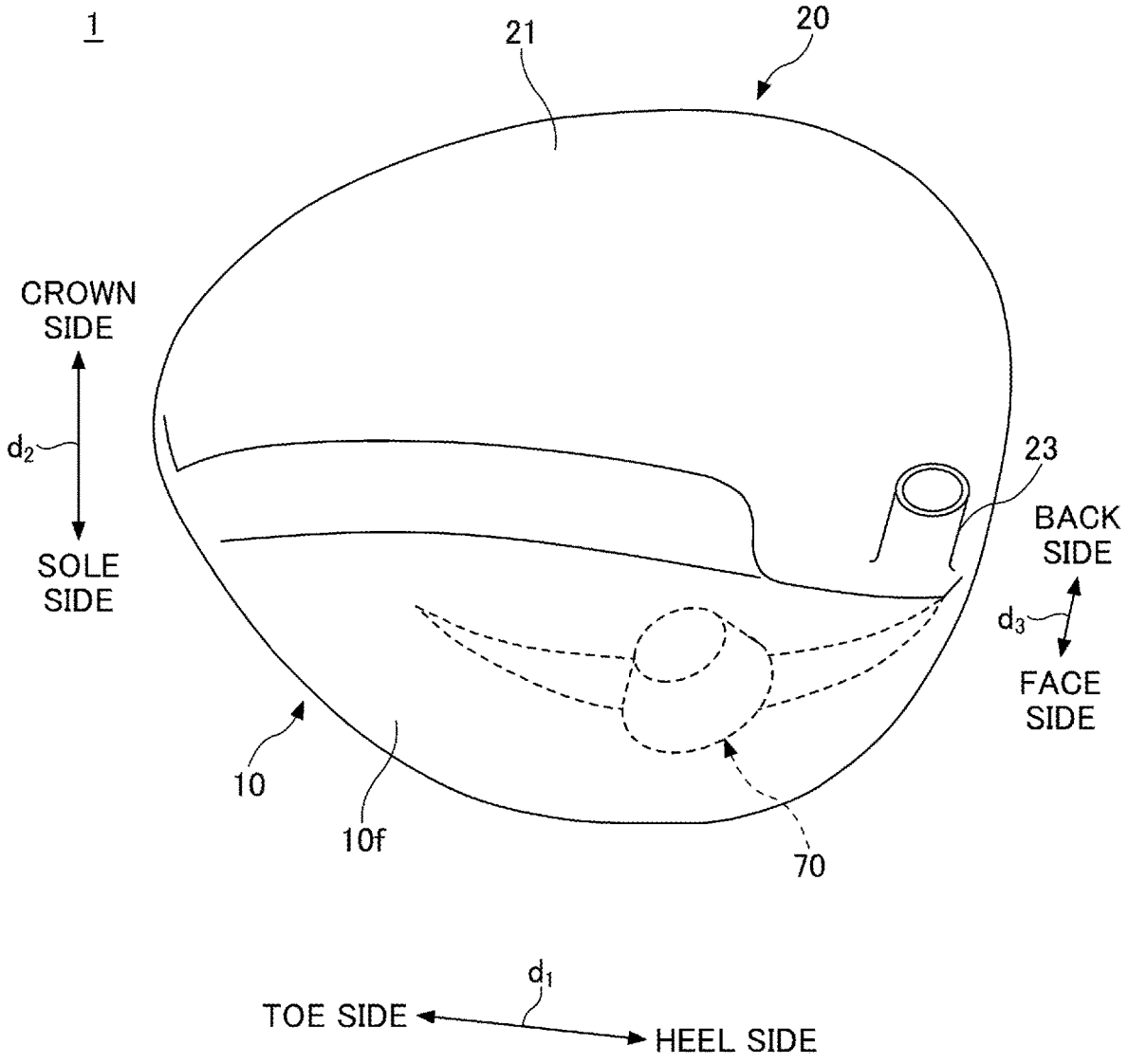
FIG. 1 is a perspective view that exemplarily illustrates a golf club head 1 according to a first embodiment.
Figure 2:
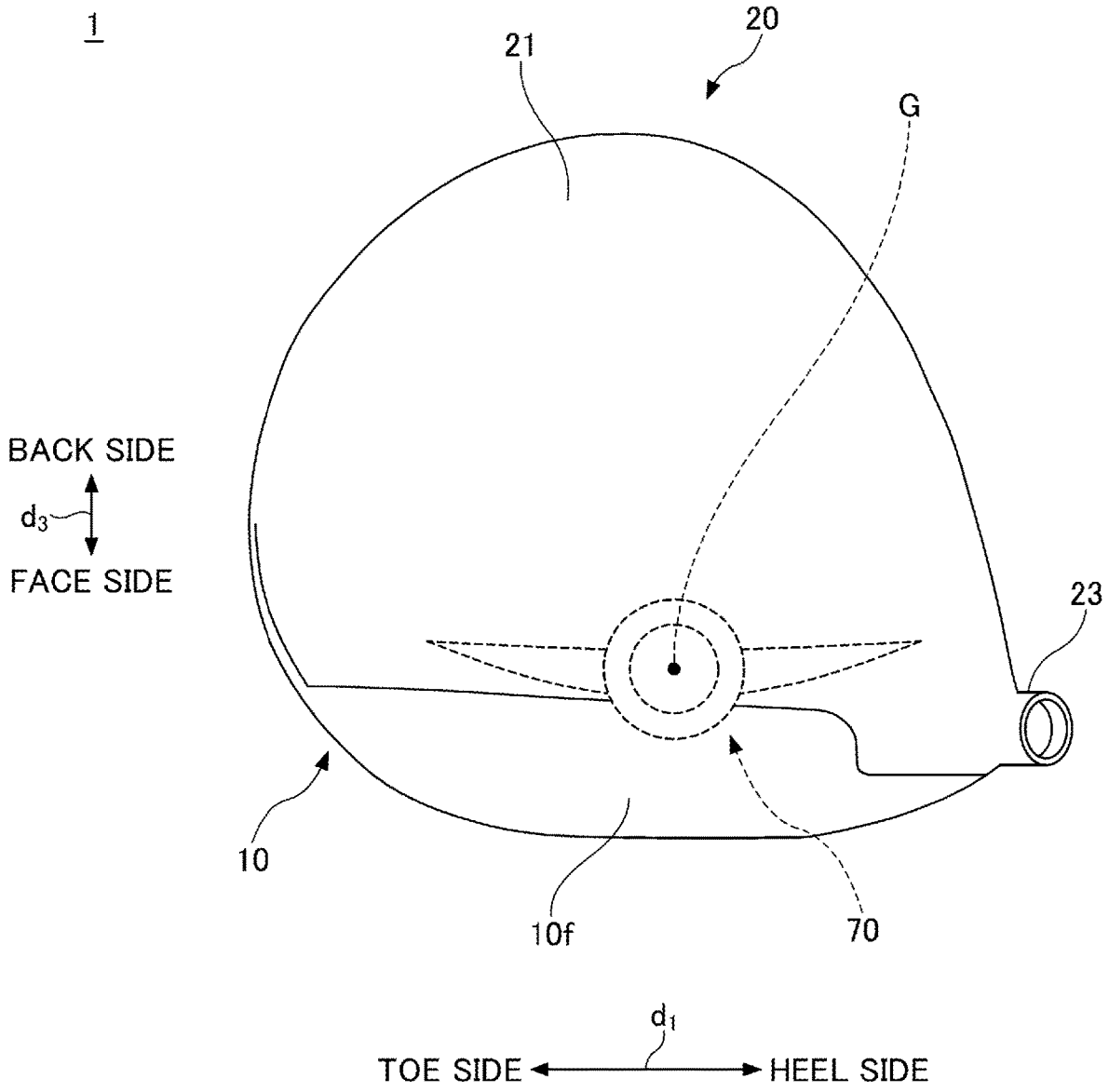
FIG. 2 is a plan view that exemplarily illustrates a golf club head 1 according to a first embodiment.
Figure 3:
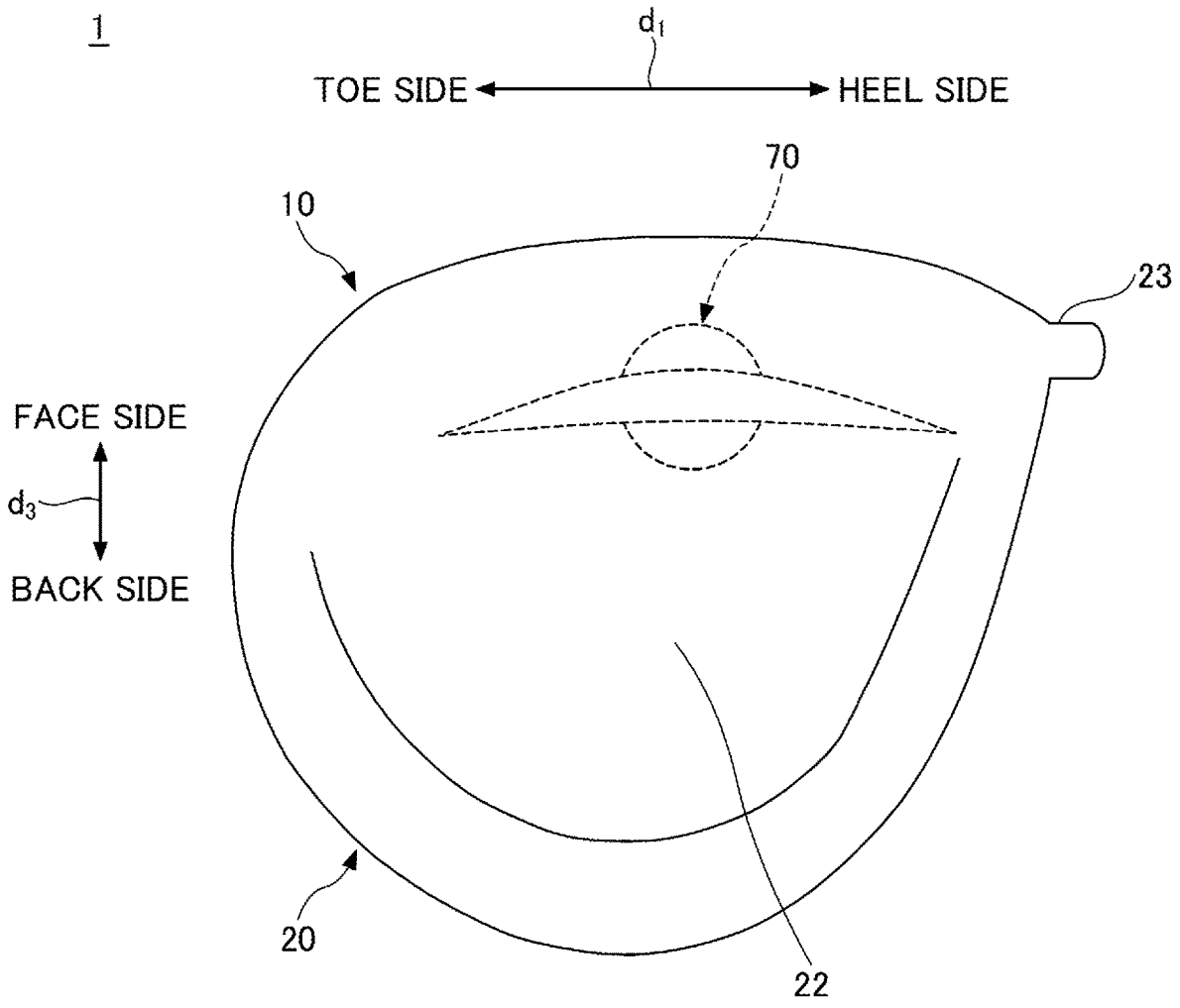
FIG. 3 is a bottom view that exemplarily illustrates a golf club head 1 according to a first embodiment.
Figure 4:
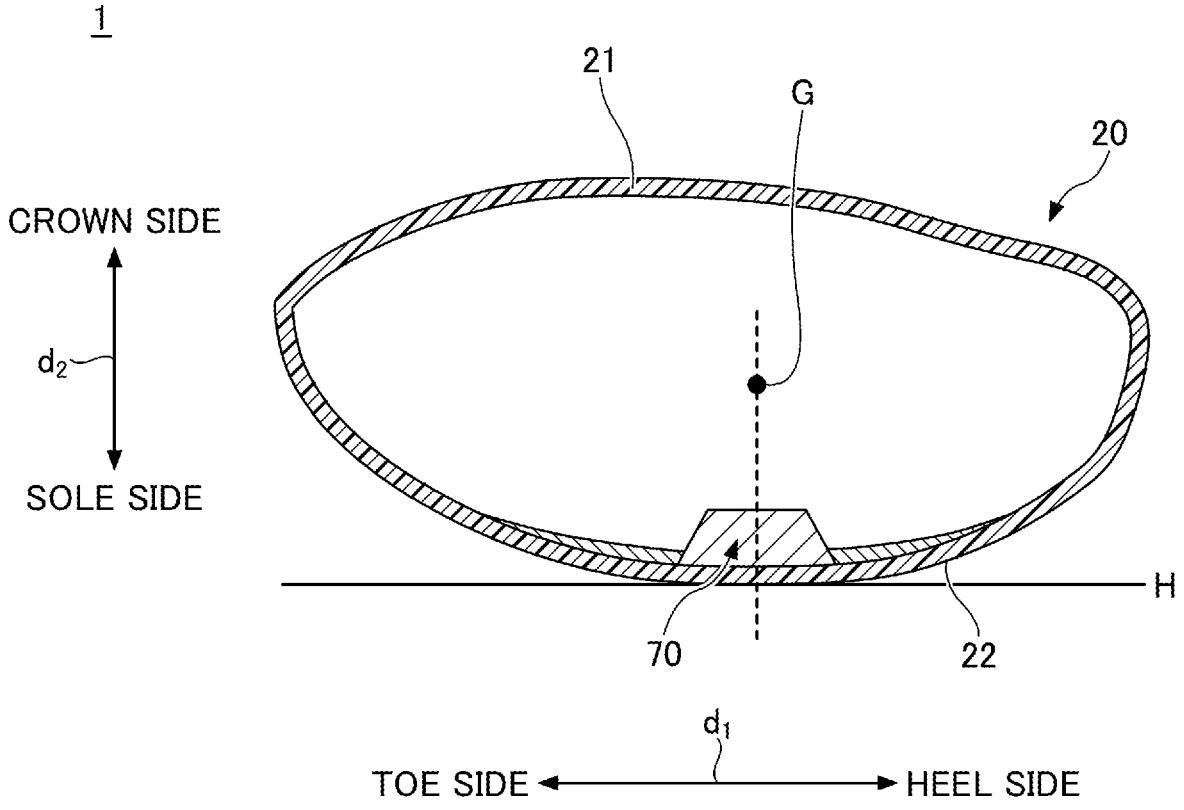
FIG. 4 is a cross-sectional view that exemplarily illustrates a golf club head 1 according to a first embodiment.

FIG. 1 is a perspective view that exemplarily illustrates the golf club head 1 according to the first embodiment. FIG. 2 is a plan view that exemplarily illustrates the golf club head 1 according to the first embodiment. FIG. 3 is a bottom view that exemplarily illustrates the golf club head 1 according to the first embodiment. FIG. 4 is a cross-sectional view that exemplarily illustrates the golf club head 1 according to the first embodiment. Note that, FIG. 4 illustrates a cross section of the golf club head 1 in a state where the golf club head 1 rests on a horizontal plane H (corresponding to the ground) in accordance with a reference lie angle and a reference loft angle, the cross section being as cut along a plane that passes through the center of gravity G of the golf club head 1, is vertical to the horizontal plane H, and is oriented along the toe-heel direction.

In FIG. 1 to FIG. 4, an arrow $d_1$ indicates the toe-heel direction (left-right direction), an arrow $d_2$ indicates a crown-sole direction (up-down direction), and an arrow $d_3$ indicates a face-back direction (front-rear direction). Note that, in the subsequent drawings, the same directions may be indicated thereby.

The golf club head 1 as illustrated in FIG. 1 to FIG. 4 is a wood-type golf club head, such as a driver. The golf club head 1 is a hollow structure including a face portion 10 and a body portion 20 that are integrally bonded to each other. The golf club head 1 has a volume of from 400 cc through 460 cc.

The body portion 20 has an opening that is opened toward a face side. A peripheral portion of the opening of the body portion 20 is provided with a step for positioning the face portion 10. The face portion 10 is bonded to the body portion 20 so as to engage with the step and cover the opening. Note that, a surface inside the hollow structure may be referred to as an inner surface, and a surface outside the hollow structure may be referred to as an outer surface.

The face portion 10 is a portion including a face surface 10*f* that is to be a striking surface. Note that, the face portion 10 has a prescribed thickness, and the face surface 10*f* forms an outer surface of the face portion 10. The face portion 10 can be formed of, for example, titanium, a titanium alloy, stainless steel, aluminum, an aluminum alloy, an iron-based metal, magnesium, or a magnesium alloy.

The face portion 10 may be formed using a fiber-reinforced resin. As used herein, the fiber-reinforced resin is a composite material of a resin and a fiber that is a reinforcing material. Examples of the fiber forming the fiber-reinforced resin include carbon fibers, glass fibers, aramid fibers, polyethylene fibers, ZYLON fibers, and boron fibers. Examples of the fiber forming the resin include epoxy resins, phenol resins, polyester resins, and polycarbonate resins. The face portion 10 can be formed of, for example, a carbon fiber-reinforced resin.

The body portion 20 includes a crown portion 21 and a sole portion 22. The body portion 20 may further include a hosel housing portion 23. The crown portion 21 is a portion that forms a top portion of the golf club head 1. The sole portion 22 is a portion that forms a bottom portion of the golf club head 1. The hosel housing portion 23 is a portion that houses a hosel to be connected to a shaft.

The body portion 20 is formed of carbon fiber-reinforced plastics. The body portion 20 can be molded by, for example, laminating carbon fiber-reinforced resin sheets. The crown portion 21, the sole portion 22, and the hosel housing portion 23 may be integrally molded by laminating carbon fiber-reinforced resin sheets.

The golf club head 1 includes the weight member 70 attached to the sole portion 22 at an inner-surface side thereof. The weight member 70 is positioned slightly closer to the heel side from an almost central portion in the toe-heel direction, and is positioned on the face portion 10 side in the face-back direction. The weight member 70 is formed, for example, so that the weight at the toe side and the weight at the heel side become almost equal to each other. Note that, the weight member 70 cannot be visually recognized from the exterior of the golf club head 1.

Figure 5A:
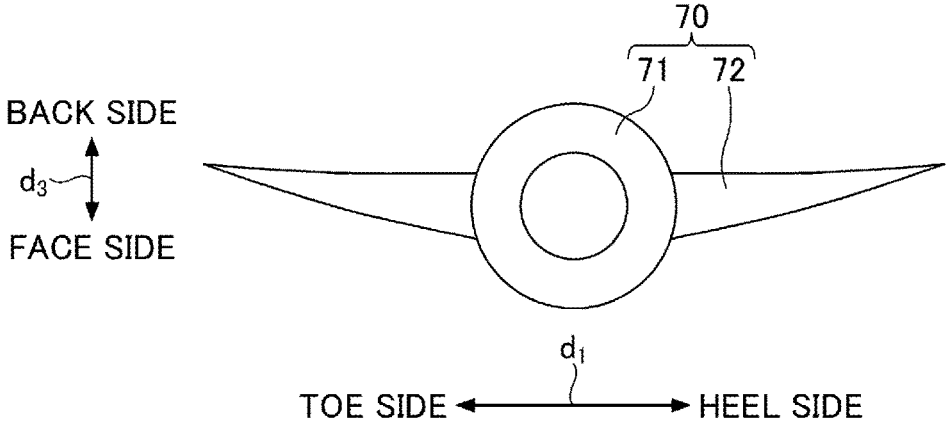
FIGS. 5A to 5C are explanatory views of a weight member 70.
Figure 5B:
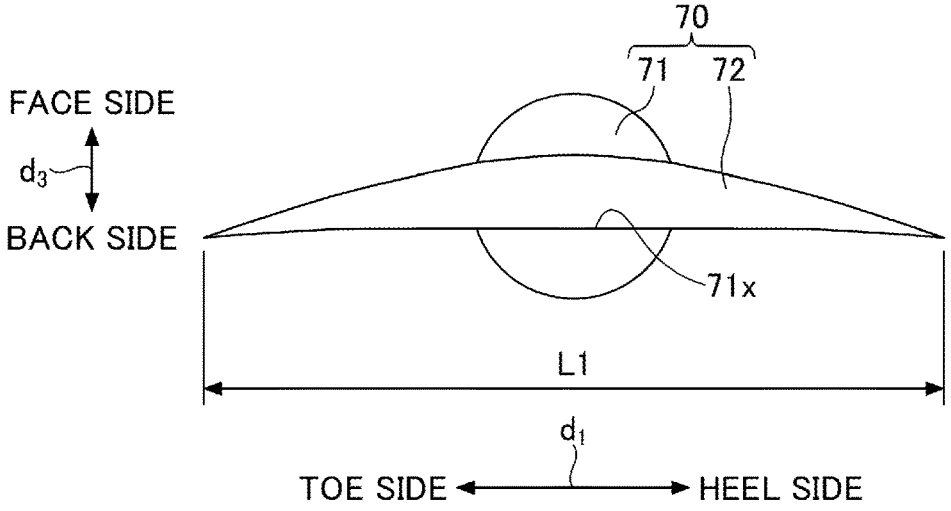
Figure 5C:
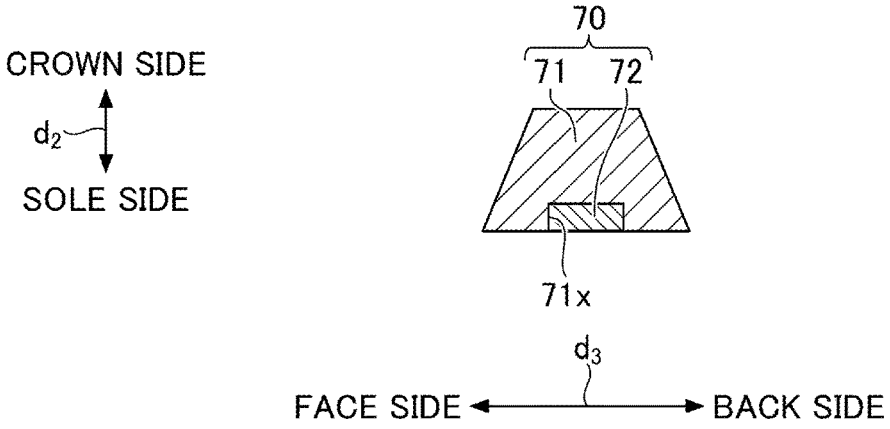

FIGS. 5A to 5C are explanatory views of the weight member 70. FIG. 5A illustrates the weight member 70 as viewed from the crown portion 21 side. FIG. 5B illustrates the weight member 70 as viewed from the sole portion 22 side. FIG. 5C illustrates, similar to FIG. 4, a cross section of the golf club head 1 in a state where the golf club head 1 rests on the horizontal plane H in accordance with the reference lie angle and the reference loft angle, the cross section being as cut along the plane that passes through the center of gravity G of the golf club head 1, is vertical to the horizontal plane H, and is oriented along the face-back direction.

As illustrated in FIGS. 5A to 5C, the weight member 70 includes a first weight member 71 and a second weight member 72. In other words, the first weight member 71 and the second weight member 72 are combined with each other to form the weight member 70. The first weight member 71 is disposed, in a plan view, near a central portion of the weight member 70 in a longitudinal direction of the weight member 70. As used herein, the expression "plan view" is a view in a vertical direction from the crown portion 21 side toward the horizontal plane H. The second weight member 72 extends, in the plan view, from the first weight member 71 in the toe-heel direction.

The first weight member 71 is disposed directly below the center of gravity G of the golf club head 1. As used herein, the expression "directly below the center of gravity G" means that in a state where the golf club head 1 rests on the horizontal plane H in accordance with the reference lie angle and the reference loft angle similar to FIG. 4, a line that passes through the center of gravity G and is vertical to the horizontal plane H crosses a portion of the first weight member 71.

The first weight member 71 has, for example, a circular truncated cone shape, and is disposed such that the bottom surface of the first weight member 71 contacts the inner surface of the sole portion 22. When the first weight member 71 has a circular truncated cone shape, for example, the diameter of a top face thereof is from 8 mm through 16 mm, the diameter of a bottom surface thereof is from 18 mm through 26 mm, and the height thereof is from 7 mm through 15 mm. Preferably, the diameter of the top face is from 9 mm through 15 mm, the diameter of the bottom surface is from 19 mm through 25 mm, and the height thereof is from 8 mm through 14 mm. More preferably, the diameter of the top face is from 10 mm through 14 mm, the diameter of the bottom surface is from 20 mm through 24 mm, and the height thereof is from 9 mm through 13 mm. When the first weight member 71 has a circular truncated cone shape, the position of the center of gravity G of the golf club head 1 can become lowered. Note that, the shape of the first weight member 71 is not limited to the circular truncated cone shape, and may be a cylindrical shape or a truncated pyramid shape.

The second weight member 72 is an elongated member that is thinner than the first weight member 71. The second weight member 72 is disposed along the inner surface of the sole portion 22. The width of the second weight member 72 (i.e., the length of the second weight member 72 in the face-back direction in the plan view) may be constant. Preferably, however, the width of the second weight member 72 is the largest at the center in a longitudinal direction of the second weight member 72 and gradually decreases toward both ends in the longitudinal direction. With this structure, the second weight member 72 becomes lighter in weight in accordance with being away from the first weight member 71, and thus it is possible to suppress change in position of the center of gravity G by the provision of the weight member 70.

In the plan view, the second weight member 72 can have, for example, a crescent moon shape. As used herein, the expression "crescent moon shape" is, in the plan view, a closed shape that is formed by connecting both ends of a first curve having a prescribed radius of curvature with both ends of a second curve that is curved in the same direction as the first curve and has a larger radius of curvature than the first curve. The second weight member 72 is disposed, in the plan view, such that a projecting side of the crescent moon shape faces the face portion 10. The radius of curvature of the first curve is, for example, from 50 mm through 100 mm, and the radius of curvature of the second curve is, for example, from 200 mm through 250 mm.

The second weight member 72 plays a role in reinforcing the sole portion 22 as a rib. When the radius of curvature of the first curve is 100 mm or smaller and the radius of curvature of the second curve is 250 mm or smaller, it is possible to enhance the effect of reinforcement as a rib. As the radii of curvature of the first and second curves are smaller, the effect of reinforcement as a rib is further enhanced, but the center of gravity of the golf club head 1 is shifted backward. When the radius of curvature of the first curve is 50 mm or larger and the radius of curvature of the second curve is 200 mm or larger, it is possible to suppress the center of gravity of the golf club head 1 from being shifted backward while enhancing the effect of reinforcement as a rib. Note that, as long as the first curve and the second curve are curved, the first curve and the second curve are not necessarily complete arc shapes.

As illustrated in FIG. 4, the sole portion 22 is curved to project toward the horizontal line H. In the case of the second weight member 72 not having the crescent moon shape but an elongated rectangular shape that extends in the toe-heel direction in the form of a straight line, both ends of the rectangular shape reach a toe-side portion and a heel-side portion, each of which is a portion that is curved from the sole portion 22 toward the crown portion 21. The toe-side portion and the heel-side portion, curved from the sole portion 22 toward the crown portion 21, are at considerably high positions from the horizontal line H. As a result, the position of the center of gravity of the golf club head 1 becomes higher.

When the second weight member 72 has the crescent moon shape, the crescent moon shape extends in the toe-heel direction as a whole, while both ends of the crescent moon shape are curved toward the back side. Therefore, both the ends of the crescent moon shape can stay at lower positions from the horizontal line H, as compared with the case of the elongated rectangular shape. It is possible to suppress the position of the center of gravity of the golf club head 1 from becoming higher. Also, since both the ends of the crescent moon shape are positioned at the sole portion 22, the sole portion 22 has increased rigidity, and it is possible to suppress vibration of the golf club head 1 upon the striking of a ball.

In the plan view, a length L1 of the second weight member 72 in the toe-heel direction is, for example, from 40 mm through 95 mm. The length L1 is preferably from 45 mm through 90 mm, and more preferably from 50 mm through 85 mm. Preferably, the maximum height of the second weight member 72 in the d2 direction is from 2 mm through 7 mm and decreases extending toward the toe side and the heel side. Preferably, the maximum width of the second weight member 72 in the d3 direction is from 7 mm through 15 mm and decreases extending toward the toe side and the heel side.

The bottom surface of the first weight member 71 includes a recessed receiving portion 71*x*. The receiving portion 71*x* is opened toward the bottom surface side of the first weight member 71 and is also opened toward the side face; i.e., the toe side and the heel side. When a portion including the central portion of the second weight member 72 in the longitudinal direction is fitted into the receiving portion 71*x*, the second weight member 72 is disposed integrally with the first weight member 71. The bottom surface of the second weight member 72 is, for example, flush with the bottom surface of the first weight member 71.

The specific gravity of the first weight member 71 is, for example, from 8 through 14. The specific gravity of the second weight member 72 is lower than the specific gravity of the first weight member 71 and higher than the specific gravity of the body portion 20. As a material usable for the first weight member 71, tungsten, a tungsten alloy, etc. can be used. As a material usable for the second weight member 72, stainless steel, titanium, aluminum, etc. can be used.

When the specific gravity of the second weight member 72 is high, the position of the center of gravity G changes. However, when the specific gravity of the second weight member 72 is lower than the specific gravity of the first weight member 71 and higher than the specific gravity of the body portion 20, it is possible to suppress change in the position of the center of gravity G.

The first weight member 71 is, for example, from 10 g through 60 g. The first weight member 71 is preferably from 15 g through 55 g, and more preferably from 20 g through 50 g. When the first weight member 71 is 10 g or more, the first weight member 71 can sufficiently exhibit effects commensurate with the provision of the first weight member 71. When the first weight member 71 is 60 g or less, it is possible to sufficiently secure adhesion strength of the first weight member 71 to the sole portion 22. The second weight member 72 is, for example, from 3 g through 12 g. The second weight member 72 is preferably from 4 g through 11 g, and more preferably from 5 g through 10 g.

Figure 6:
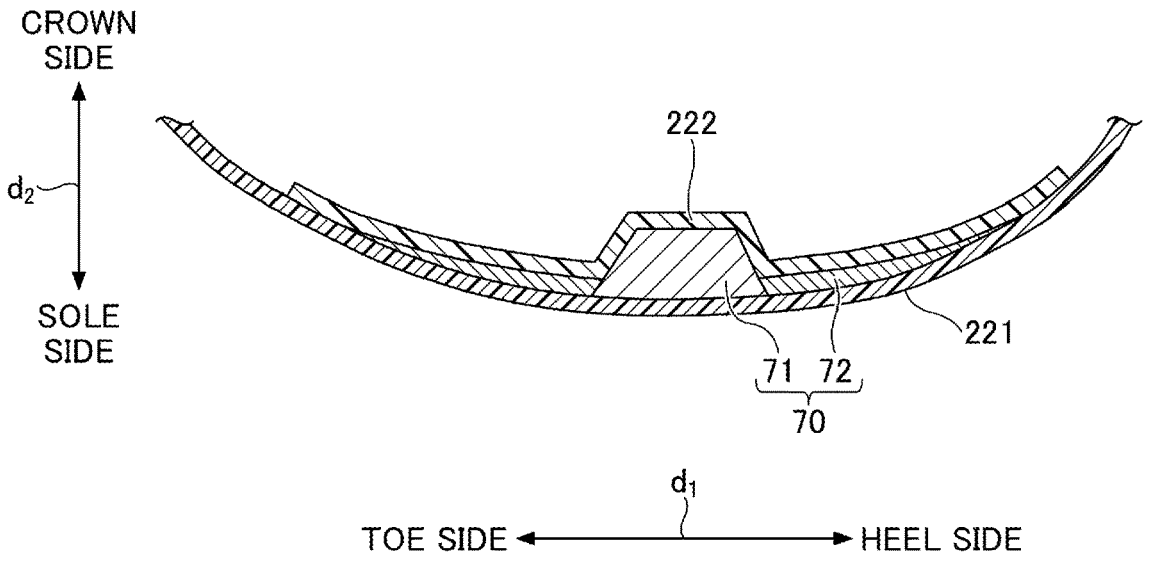
FIG. 6 exemplarily illustrates a state where a weight member 70 is embedded within layers of fiber-reinforced resin sheets.

As illustrated in FIG. 6, the weight member 70 is preferably embedded within layers of a fiber-reinforced resin sheet 221 forming the sole portion 22 and a fiber-reinforced resin sheet 222 laminated on the fiber-reinforced resin sheet 221. The fiber-reinforced resin sheets 221 and 222 are, for example, carbon fiber-reinforced resin sheets. Note that, the fiber-reinforced resin sheet 222-facing surface of the fiber-reinforced resin sheet 221 is the inner surface of the sole portion 22. When the first weight member 71 has a circular truncated cone shape, it is possible to increase adhesion strength of the first weight member 71 to the fiber-reinforced resin sheets 221 and 222 as compared with when the first weight member 71 has a cylindrical shape.

In FIG. 6, the bottom surfaces of the first weight member 71 and the second weight member 72 contact the fiber-reinforced resin sheet 221. Also, the top face and the side face of the first weight member 71 contact the fiber-reinforced resin sheet 222, and the top face and the side faces of the second weight member 72 exposed from the first weight member 71 contact the fiber-reinforced resin sheet 222. In other words, the fiber-reinforced resin sheet 222 is disposed along the top face of the weight member 70. Note that, either or both of the fiber-reinforced resin sheets 221 and 222 may be a laminated structure of a plurality of fiber-reinforced resin layers.

In this way, in the golf club head 1, the weight member 70 is sandwiched between the layers of the fiber-reinforced resin sheets next to each other, and is not exposed to the inner surface or the outer surface of the body portion 20. With this structure, the weight member 70 can be readily fixed to the sole portion 22 at the inner-surface side thereof. Also, since the weight member 70 includes not only the first weight member 71 but also the second weight member 72 extending in the toe-heel direction, the weight member 70 can be embedded within the layers of the fiber-reinforced resin sheets next to each other in a broader range than when the weight member 70 includes only the first weight member 71. As a result, it becomes possible to sufficiently ensure the embedded strength of the weight member 70 by virtue of the fiber-reinforced resin sheets, and to suppress the fiber-reinforced resin sheet from being peeled off upon the striking of a ball. In order to suppress the fiber-reinforced resin sheet from being peeled off upon the striking of a ball, the length L1 is preferably within the above-described range.

The golf club head 1 can be produced using, for example, a mold assembly and a pneumatic molding machine. The mold assembly can be assembled and disassembled. The pneumatic molding machine includes an opening and closing hermetically sealing vessel, and a gas pressure-generating mechanism and a heating mechanism that are attached to the opening and closing hermetically sealing vessel.

Specifically, the golf club head 1 is produced by, for example, the following method. First, the mold assembly, which can be assembled and disassembled, is provided. Second, a plurality of sheets of a pre-impregnated material (a prepreg material) formed of the fiber-reinforced resin are provided. Third, the sheets of the pre-impregnated material are attached to the mold assembly so as to be laminated, thereby forming an original form of the body portion 20.

Note that, in order to integrally mold the weight member 70 with the fiber-reinforced resin of either or both of the crown portion 21 and the sole portion 22, the weight member 70 may be placed in the original form of the body portion 20 when the sheets of the pre-impregnated material are attached to the mold assembly so as to be laminated to form the original form of the body portion 20. Specifically, the weight member 70 may be attached to the pre-impregnated material, or the weight member 70 may be enclosed in the pre-impregnated material.

Next, the mold assembly housing the original form of the body portion 20 is placed in a bag. Then, the bag is placed in the opening and closing hermetically sealing vessel, followed by application of a vacuum negative pressure with the gas pressure-generating mechanism and by application of heat with the heating mechanism. Thereby, the pre-impregnated material formed of the fiber-reinforced resin in the original form of the body portion 20 is cured by a crosslinking reaction. The body portion is heat-molded and then adhesively bonded to the preformed face portion 10, thereby forming a semi-product of the golf club head 1. The semi-product of the golf club head 1 is deburred and subjected to surface processing, thereby forming the golf club head 1 as a final product.

Note that, in the application of the vacuum negative pressure with the gas pressure-generating mechanism and the application of the heat with the heating mechanism, for example, a value of the vacuum negative pressure can be set to be from −0.1 mbar through −1,000 mbar, the heating temperature can be set to be from 40° C. through 250° C., and the duration of the application of the vacuum negative pressure and the heat can be set to be from 1 minute through 60 minutes.

As the pneumatic molding machine, for example, a pressure vessel can be used. When a pressure vessel is used as the pneumatic molding machine, vacuum suction, heating, and air pressurization can be performed to the original form of the golf club head 1. The pressure value of the pressurized air can be, for example, from 2 bar through 100 bar.

Also, the value of the vacuum negative pressure, the heating temperature, and the pressure value of the pressurized air can be adjusted in accordance with, for example, the wood-type golf club heads having different outer shapes and the pre-impregnated materials formed of the fiber-reinforced resin having different thicknesses. Moreover, the value of the vacuum negative pressure, the heating temperature, and the pressure value of the pressurized air can also be adjusted in accordance with the crosslinking reaction of the pre-impregnated material formed of the fiber-reinforced resin. In other words, by forming the body portion from the fiber-reinforced resin, the shape and weight of the golf club head can be readily controlled.

In this way, the golf club head 1 includes the weight member 70 attached to the sole portion 22 at the inner-surface side thereof. The weight member 70 includes the first weight member 71 disposed directly below the center of gravity G, and the second weight member 72 extending from the first weight member 71 in the toe-heel direction.

In the golf club head 1 having a large volume (from 400 cc through 460 cc), disposing the first weight member 71 directly below the center of gravity G can make a user feel that it is comfortable to swing a golf club with the golf club head 1, as compared with when the first weight member 71 is disposed at a position away from the position directly below the center of gravity G. Also, this positioning of the first weight member 71 can make a user feel that it is comfortable to control a golf club with the golf club head 1.

Also, if only the first weight member 71 is disposed directly below the center of gravity G, a striking sound is not stable and a sufficient strength of the golf club head cannot be obtained. By attaching, to the sole portion 22 at the inner-surface side thereof, not only the first weight member 71 but also the second weight member 72 extending from the first weight member 71 in the toe-heel direction, the second weight member 72 plays a role as a rib, and thus the striking sound becomes stable and the strength of the golf club head 1 can be increased.

Modified Example 1 of the First Embodiment

Modified Example 1 of the first embodiment presents an example of a golf club head in which a different material from that in the first embodiment is used for a body portion of the golf club head. Note that, in Modified Example 1 of the first embodiment, description of the same components as those in the already described embodiment may be omitted.

Figure 7:
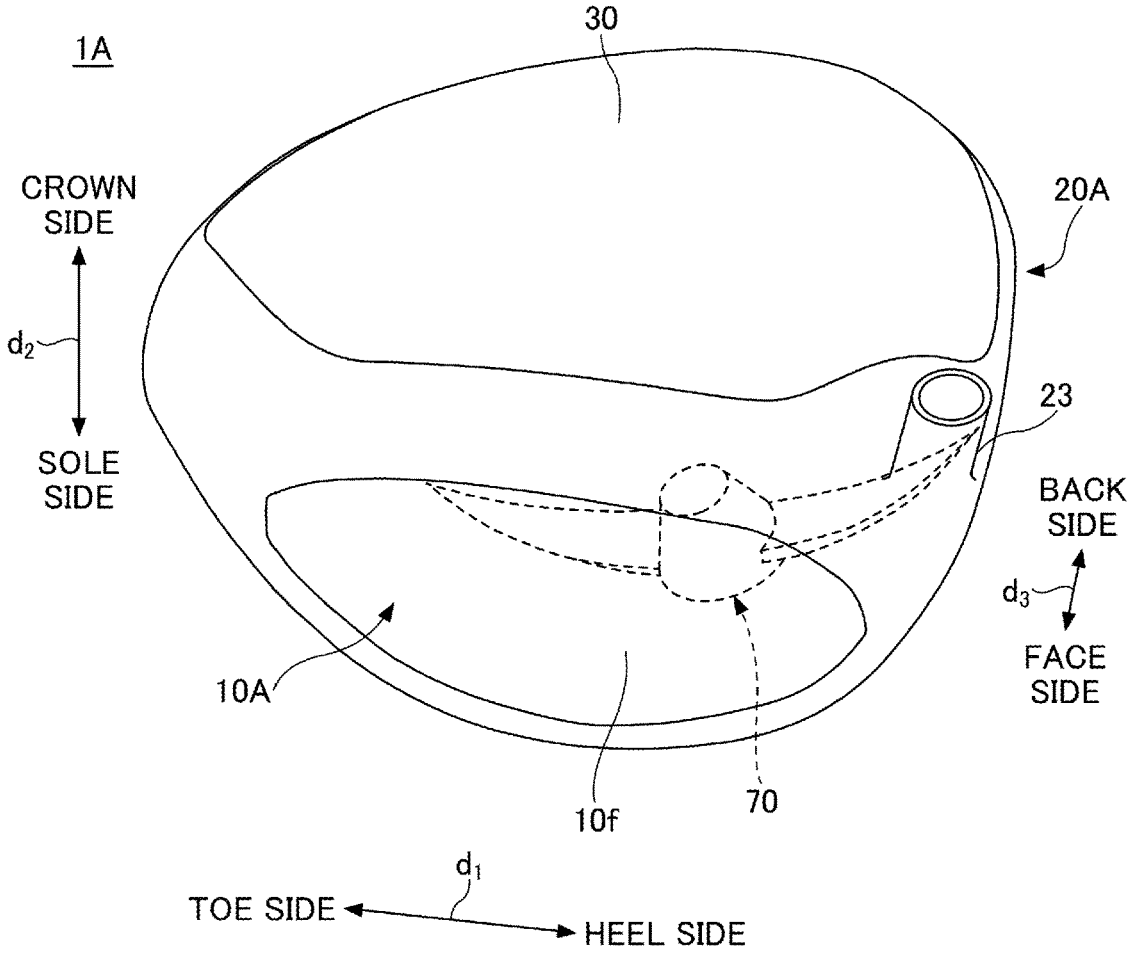
FIG. 7 is a perspective view that exemplarily illustrates a golf club head 1A according to Modified Example 1 of the first embodiment.
Figure 8:
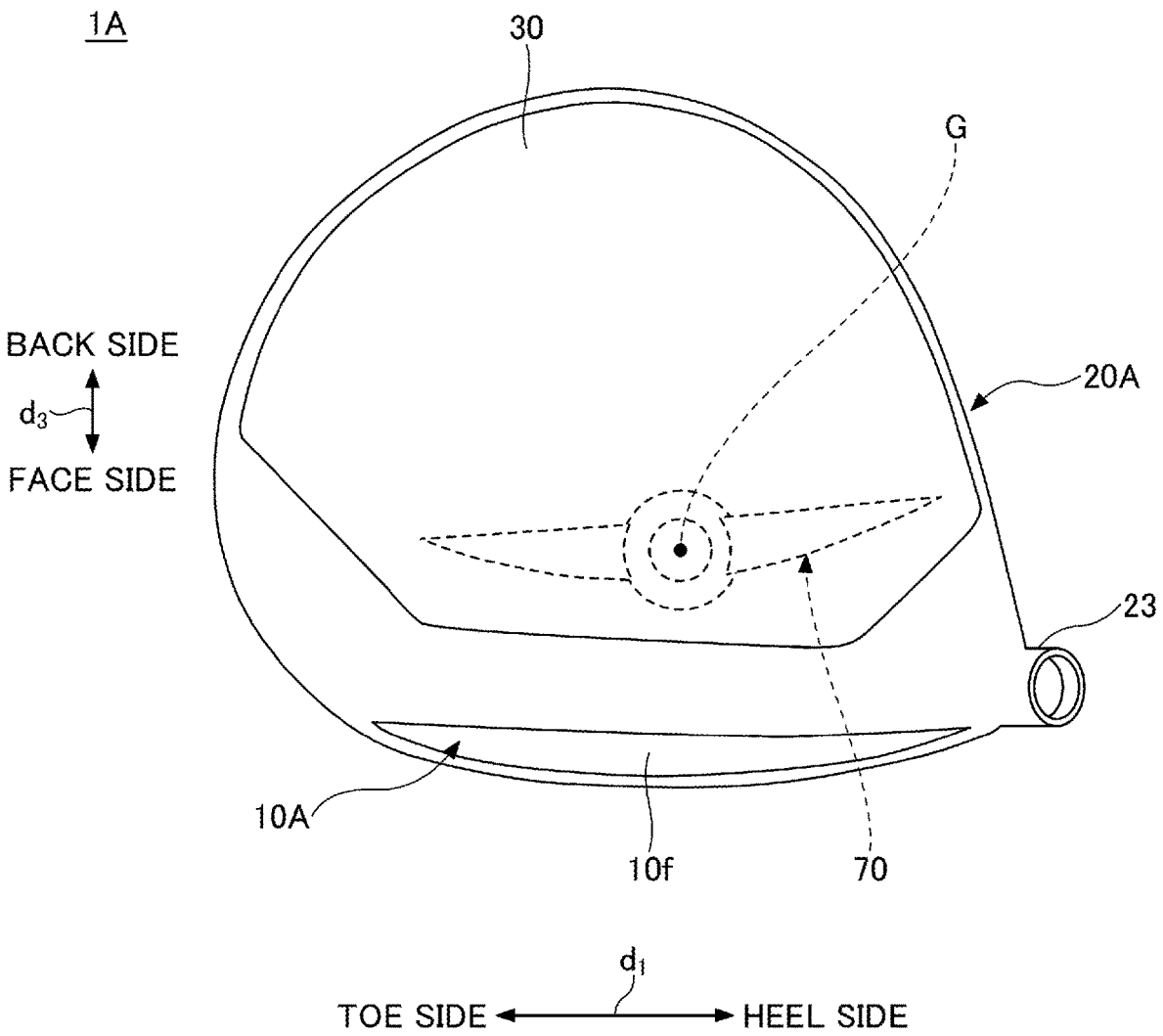
FIG. 8 is a plan view that exemplarily illustrates a golf club head 1A according to Modified Example 1 of the first embodiment.
Figure 9:
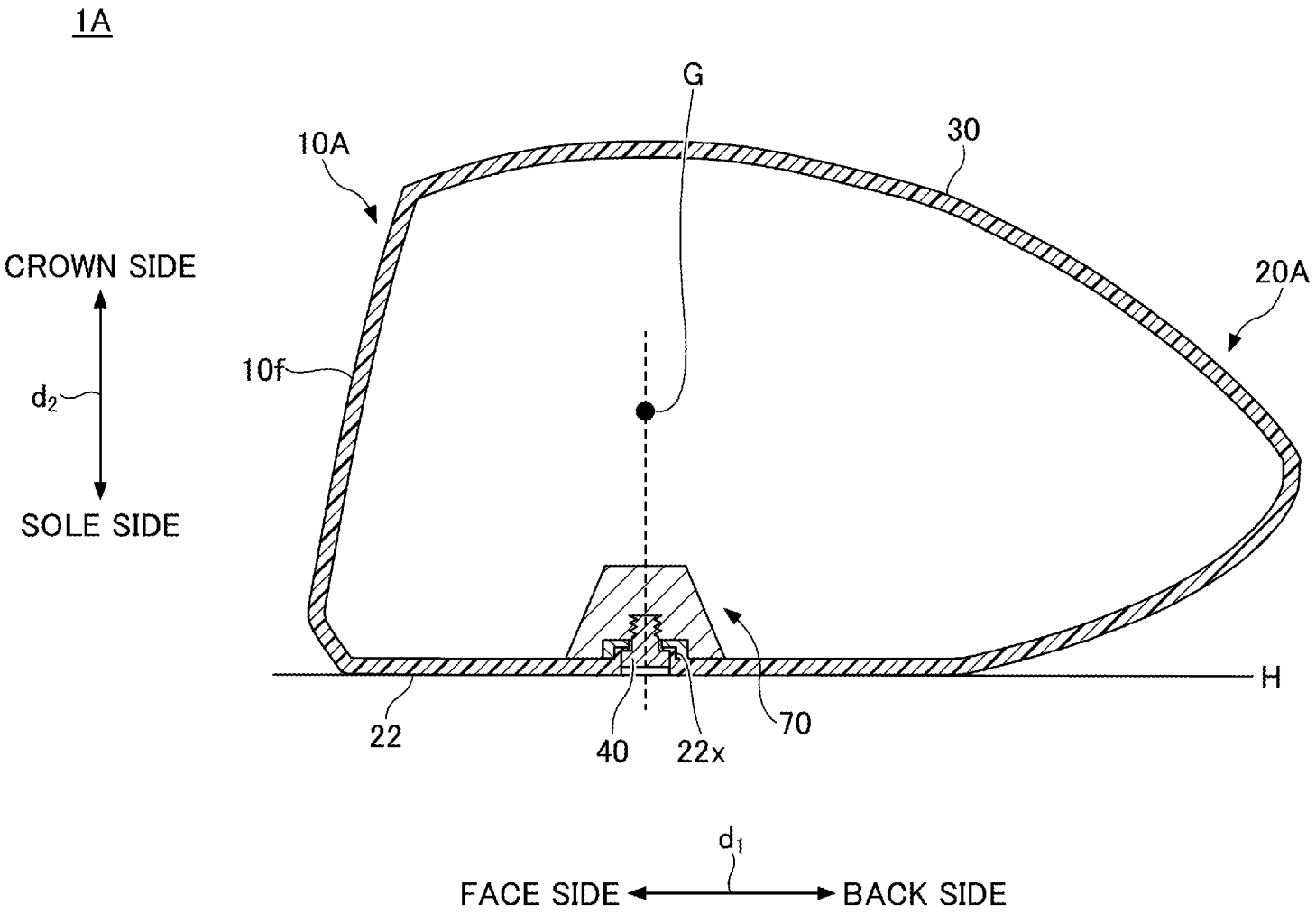
FIG. 9 is a cross-sectional view that exemplarily illustrates a golf club head 1A according to Modified Example 1 of the first embodiment.
Figure 10:
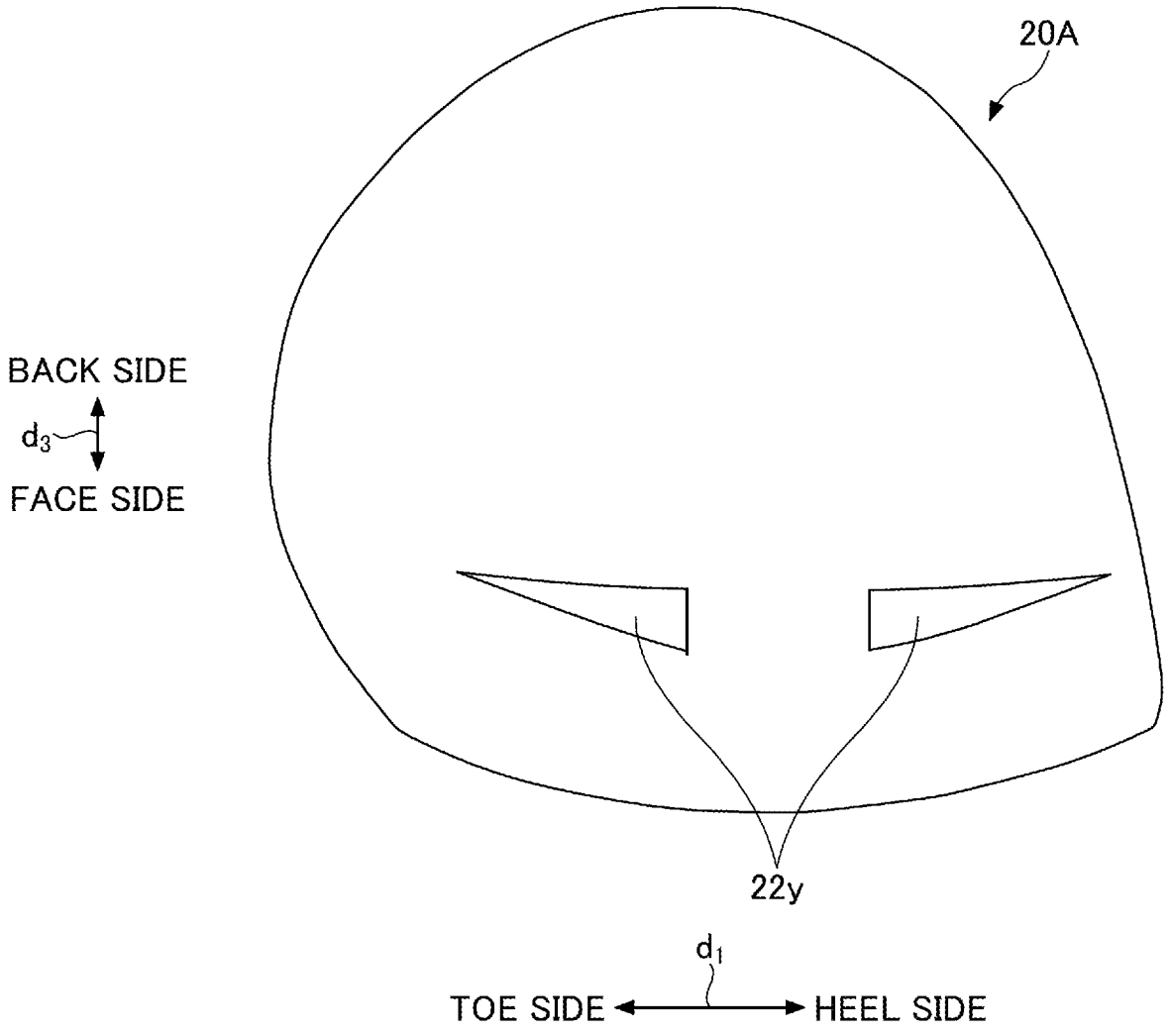
FIG. 10 is a plan view that exemplarily illustrates a sole portion of the golf club head 1A according to Modified Example 1 of the first embodiment.

FIG. 7 is a perspective view that exemplarily illustrates a golf club head 1A according to Modified Example 1 of the first embodiment. FIG. 8 is a plan view that exemplarily illustrates the golf club head 1A according to Modified Example 1 of the first embodiment. FIG. 9 is a cross-sectional view that exemplarily illustrates the golf club head 1A according to Modified Example 1 of the first embodiment. Note that, FIG. 9 illustrates a cross section of the golf club head 1A in a state where the golf club head 1A rests on the horizontal plane H (corresponding to the ground) in accordance with the reference lie angle and the reference loft angle, the cross section being as cut along the plane that passes through the center of gravity G of the golf club head 1A, is vertical to the horizontal plane H, and is oriented in the face-back direction. FIG. 10 is a plan view that exemplarily illustrates the sole portion of the golf club head 1A according to Modified Example 1 of the first embodiment, and omits illustration of a portion above the sole portion and schematically illustrates an inner-surface side of the sole portion as viewed from the crown side.

The golf club head 1A as illustrated in FIG. 7 to FIG. 10 is a wood-type golf club head, such as a driver. The golf club head 1A includes a face portion 10A, a body portion 20A, and a crown portion 30.

The body portion 20A has an opening that is opened toward the face side, and the face portion 10A is bonded to the body portion 20A so as to cover the opening. Also, the body portion 20A has an opening that is opened toward the crown side, and the crown portion 30 is bonded to the body portion 20A so as to cover the opening. The golf club head 1A is a hollow structure including the face portion 10A and the crown portion 30 that are integrally bonded to the body portion 20A. The golf club head 1A has a volume of from 400 cc through 460 cc.

The face portion 10A is a portion including a face surface 10*f* that is to be a striking surface. Note that, the face portion 10A has a prescribed thickness, and the face surface 10*f* forms an outer surface of the face portion 10A. The face portion 10A and the body portion 20A are formed of, for example, a metal. The face portion 10A, the body portion 20A, and the crown portion 30 can be formed using, for example, titanium, a titanium alloy, stainless steel, aluminum, an aluminum alloy, an iron-based metal, magnesium, or a magnesium alloy. The face portion 10A may be formed of a fiber-reinforced resin. The crown portion 30 may be formed of a fiber-reinforced resin.

The body portion 20A includes a sole portion 22. The body portion 20A may further include a hosel housing portion 23. The sole portion 22 is a portion that forms a bottom portion of the golf club head 1A. The hosel housing portion 23 is a portion that houses a hosel to be connected to a shaft. The crown portion 30 is a portion that forms a top portion of the golf club head 1A.

Similar to the golf club head 1, the golf club head 1A includes a weight member 70 attached to the sole portion 22 at an inner-surface side thereof. The weight member 70 includes a first weight member 71 and a second weight member 72, and the first weight member 71 is disposed directly below the center of gravity G of the golf club head 1A. Similar to the golf club head 1, the weight member 70 cannot be visually recognized from the exterior of the golf club head 1A.

The specific gravity and materials of the first weight member 71 and the second weight member 72 can be similar to, for example, those for the golf club head 1. The first weight member 71 is, for example, from 10 g through 30 g. The first weight member 71 is preferably from 12 g through 28 g, and more preferably from 14 g through 26 g. The second weight member 72 is, for example, from 2 g through 10 g. The second weight member 72 is preferably from 2.5 g through 9.5 g, and more preferably from 3 g through 9 g. The first weight member 71 and the second weight member 72 are lighter than those of the golf club head 1. This is for avoiding the whole golf club head 1A having too heavy a weight, as there is less extra weight by which the golf club head 1A can increase due to the body portion 20A being heavier than the body portion 20.

The golf club head 1A includes a projecting portion 22*x* that projects from the sole portion 22 in a direction extending from the outer surface of the sole portion 22 across the inner surface of the sole portion 22. The projecting portion 22*x* is a projecting portion for fastening the first weight member 71 and the second weight member 72. The weight member 70 is fastened to the projecting portion 22*x* with a fastening portion 40. Also, as illustrated in FIG. 10, the sole portion 22 preferably has groove portions 22*y* in which the second weight member 72 is to be disposed. Thereby, it is possible to position the second weight member 72 and suppress the second weight member 72 from moving upon the striking of a ball.

Figure 11A:
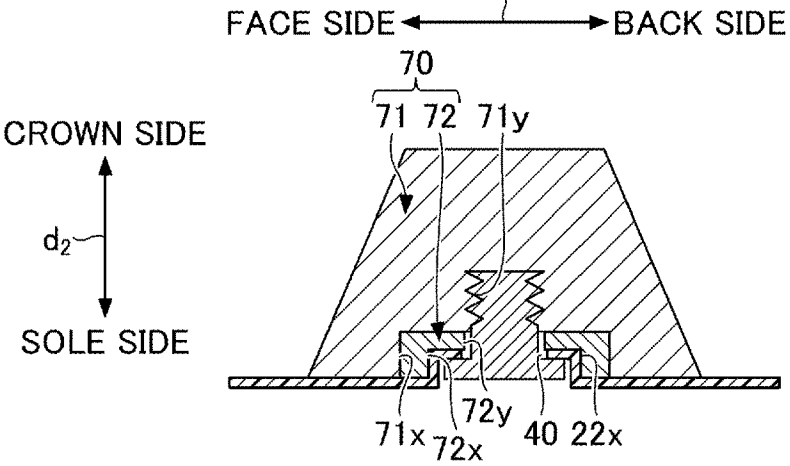
FIGS. 11A to 11C illustrate one example of a fastening method of a weight member 70.
Figure 11B:
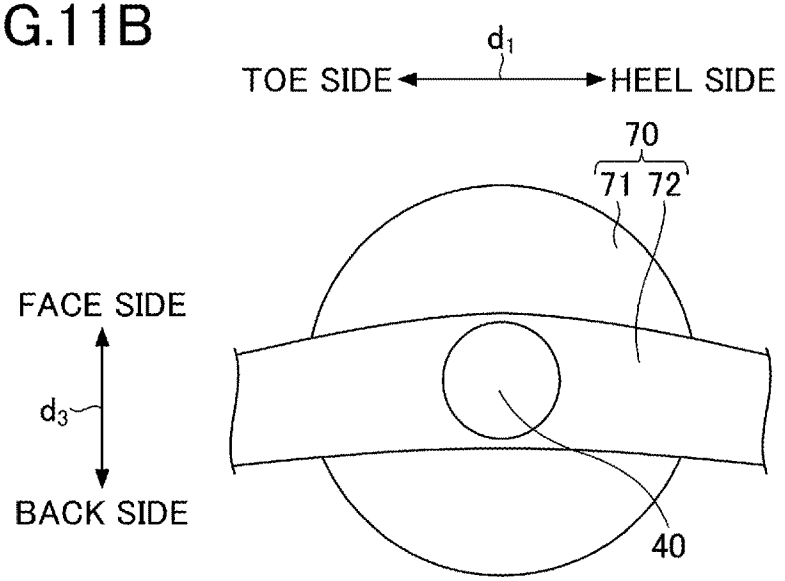
Figure 11C:
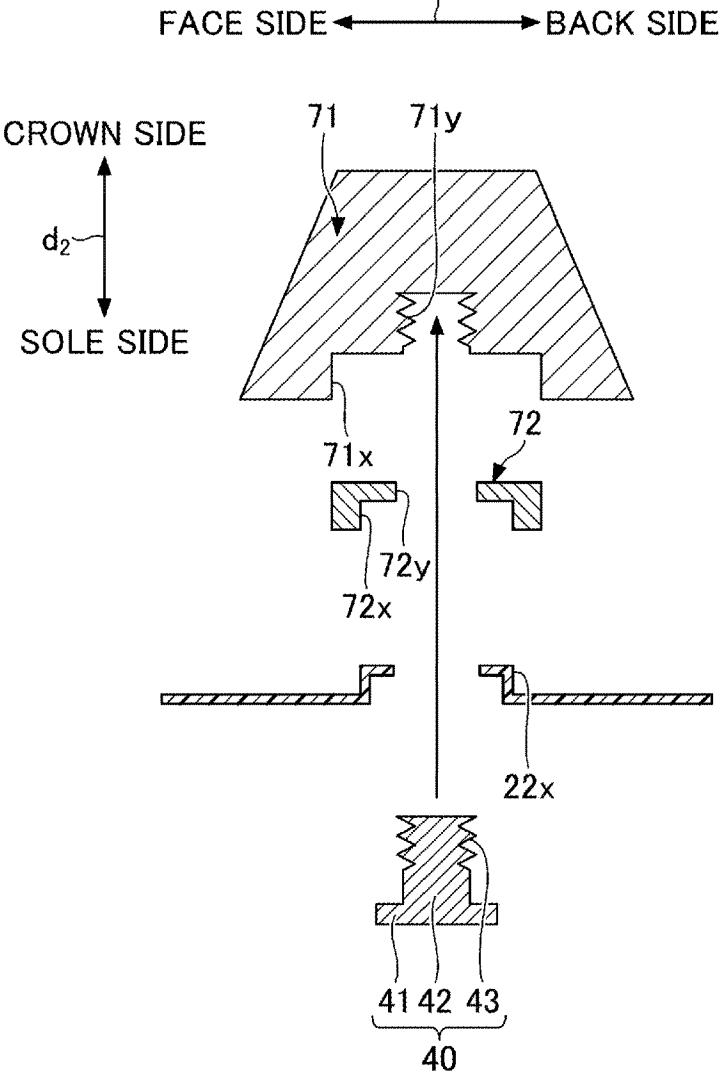

FIGS. 11A to 11C illustrate one example of a fastening method of the weight member 70. FIG. 11A illustrates, similar to FIG. 4, a cross section of the golf club head 1A in a state where the golf club head 1A rests on the horizontal plane H in accordance with the reference lie angle and the reference loft angle, the cross section being as cut along the plane that passes through the center of gravity G of the golf club head 1A, is vertical to the horizontal plane H, and is oriented along the face-back direction. FIG. 11B is a view of the weight member 70 as viewed from the sole portion 22 side. FIG. 11C is an exploded view of what are illustrated in FIG. 11A.

As illustrated in FIG. 11A to FIG. 11C, the bottom surface of the second weight member 72 includes a recessed portion 72*x* that is recessed toward the receiving portion 71*x* side of the first weight member 71. The recessed portion 72*x* is, for example, circular as viewed from the sole portion 22 side. Also, a through-hole 72*y* is formed at a central portion of the recessed portion 72*x*. The through-hole 72*y* is, for example, a circle having a smaller diameter than the recessed portion 72*x*, as viewed from the sole portion 22 side. Also, an internal thread portion 71*y* in communication with the through-hole 72*y* is formed at the central portion of the receiving portion 71*x*.

The fastening portion 40 includes, for example, a head portion 41, a cylindrical portion 42, and an external thread portion 43. The cylindrical portion 42 and the external thread portion 43 are provided at one side of the head portion 41 and concentrically with the head portion 41. The head portion 41 is, for example, circular as viewed from the sole portion 22 side. The cylindrical portion 42 and the external thread portion 43 are, for example, a circle having a smaller diameter than the head portion 41, as viewed from the crown portion 30 side.

The head portion 41 is provided with, for example, a cross-shaped or hexagonal groove. The head portion 41 does not project from the outer surface of the sole portion 22. As materials of the head portion 41, the cylindrical portion 42, and the external thread portion 43, for example, metals such as titanium, titanium alloys, aluminum, aluminum alloys, tungsten, tungsten alloys, stainless steel, and iron-based metals can be used.

In order to fasten the weight member 70 with the projecting portion 22*x*, first, the recessed portion 72*x* of the second weight member 72 is fitted to the projecting portion 22*x*, and the second weight member 72 is fitted to the receiving portion 71*x* of the first weight member 71. Then, the external thread portion 43 side of the fastening portion 40 is disposed in the through-hole 72*y*. The tip portion of, for example, a Phillips screwdriver or a hexagonal wrench is inserted into the groove of the head portion 41, followed by rotating the fastening portion 40. Thereby, it is possible to screw the external thread portion 43 of the fastening portion 40 into the internal thread portion 71*y* of the first weight member 71. Thereby, the weight member 70 is fastened with the projecting portion 22*x* via the fastening portion 40. Note that, the external thread portion 43 of the fastening portion 40 may be adhered with the internal thread portion 71*y* of the first weight member 71. Thereby, it is possible to increase attachment strength of the weight member 70.

In this way, the first weight member 71 and the second weight member 72 are fastened with the projecting portion 22*x* by different fastening methods. Specifically, the first weight member 71 can be fastened with the projecting portion 22*x* of the sole portion 22 through screwing. The second weight member 72 can be fastened with the projecting portion 22*x* through fitting to the receiving portion 71*x* of the first weight member 71, and screwing.

As described above, the golf club head 1A includes the weight member 70 attached to the sole portion 22 at the inner-surface side thereof. The weight member 70 includes the first weight member 71 disposed directly below the center of gravity G, and the second weight member 72 extending from the first weight member 71 in the toe-heel direction. Thereby, similar to the golf club head 1, it is possible to make a user feel that it is comfortable to swing a golf club with the golf club head 1A. Also, it is possible to make a user feel that it is comfortable to control a golf club with the golf club head 1A.

Also, similar to the golf club head 1, by attaching, to the sole portion 22 at the inner-surface side thereof, not only the first weight member 71 but also the second weight member 72 extending from the first weight member 71 in the toe-heel direction, the second weight member 72 plays a role as a rib, and thus the striking sound becomes stable and the strength of the golf club head 1A can be increased.

Although the embodiments have been described above in detail, the present disclosure is not limited to the above-described embodiments, and various modifications and substitutions can be made therein without departing from the scope of claims recited.

What is claimed is:

1. A golf club head having a volume of from 400 cc through 460 cc, the golf club head comprising:

a face portion that includes a face surface that is to be a striking surface; and a body portion that includes carbon fiber-reinforced plastics, the body portion including a sole portion, a crown portion, and a weight member attached to the sole portion at an inner-surface side thereof, wherein the weight member includes a first weight member that is disposed directly below a center of gravity of the golf club head, and a second weight member that extends from the first weight member in a toe-heel direction, wherein:

the first weight member is from 20 g through 50 g; and the second weight member is from 5 g through 10 g.

2. The golf club head according to claim 1, wherein:

a bottom surface of the first weight member includes a recessed receiving portion; and the second weight member is fitted to the recessed receiving portion, and is disposed integrally with the first weight member.

3. The golf club head according to claim 1, wherein:

the body portion includes carbon fiber-reinforced resin sheets that are laminated; and the first weight member and the second weight member are embedded within layers of the carbon fiber-reinforced resin sheets.

4. A golf club head having a volume of from 400 cc through 460 cc, the golf club head comprising:

a face portion that includes a face surface that is to be a striking surface; and a body portion that includes a metal, the body portion including a sole portion, and a weight member attached to the sole portion at an inner-surface side thereof, wherein the weight member includes a first weight member that is disposed directly below a center of gravity of the golf club head, and a second weight member that extends from the first weight member in a toe-heel direction, wherein:

the first weight member is from 14 g through 26 g; and the second weight member is from 3 g through 9 g.

5. The golf club head according to claim 4, further comprising:

a projecting portion that projects from the sole portion in a direction extending from an outer surface of the sole portion across the inner surface of the sole portion, the projecting portion being configured to fasten the first weight member and the second weight member, wherein the first weight member is fastened with the projecting portion by a first fastening method, and the second weight member is fastened with the projecting portion by a second fastening method.

6. The golf club head according to claim 1, wherein the first weight member has a circular truncated cone shape, and is disposed such that a bottom surface of the first weight member faces the inner surface of the sole portion.

7. The golf club head according to claim 1, wherein:

the second weight member is disposed along the inner surface of the sole portion; and in a plan view, the second weight member has a crescent moon shape.

8. The golf club head according to claim 7, wherein in the plan view, a length of the second weight member in the toe-heel direction is from 40 mm through 95 mm.

9. The golf club head according to claim 1, wherein:

a specific gravity of the first weight member is from 8 through 14; and a specific gravity of the second weight member is lower than the specific gravity of the first weight member and higher than a specific gravity of the body portion.

10. The golf club head according to claim 4, wherein the first weight member has a circular truncated cone shape, and is disposed such that a bottom surface of the first weight member faces the inner surface of the sole portion.

11. The golf club head according to claim 4, wherein:

the second weight member is disposed along the inner surface of the sole portion; and in a plan view, the second weight member has a crescent moon shape.

12. The golf club head according to claim 11, wherein in the plan view, a length of the second weight member in the toe-heel direction is from 40 mm through 95 mm.

13. The golf club head according to claim 4, wherein:

a specific gravity of the first weight member is from 8 through 14; and a specific gravity of the second weight member is lower than the specific gravity of the first weight member and higher than a specific gravity of the body portion.

* * * * *